US007275917B1

(12) United States Patent
Hicks

(10) Patent No.: US 7,275,917 B1
(45) Date of Patent: Oct. 2, 2007

(54) SAFETY DEVICE FOR HYDRAULIC PUMP

(75) Inventor: W. Glen Hicks, Minden, LA (US)

(73) Assignee: Clement Industries, Inc., Minden, LA (US)

( * ) Notice: Subject to any disclaimer, the term of this patent is extended or adjusted under 35 U.S.C. 154(b) by 138 days.

(21) Appl. No.: 10/899,275

(22) Filed: Jul. 26, 2004

(51) Int. Cl.
*F04B 49/10* (2006.01)

(52) U.S. Cl. ..... 417/53; 417/63; 417/364

(58) Field of Classification Search ..... 417/63, 417/364, 53
See application file for complete search history.

(56) References Cited

U.S. PATENT DOCUMENTS 3,497,133 A * 2/1970 Witte et al. ..... 417/364
4,203,710 A * 5/1980 Farr ..... 417/53
4,241,566 A * 12/1980 Webster ..... 56/14.6
5,237,310 A * 8/1993 Smith ..... 340/679
5,242,278 A * 9/1993 Vanderslice et al. ..... 417/364
5,765,995 A * 6/1998 Springer ..... 417/40
7,088,227 B2 * 8/2006 Ward ..... 340/451

* cited by examiner

*Primary Examiner*—Michael Koczo, Jr.
(74) *Attorney, Agent, or Firm*—Thompson & Gustavson L.L.P.

(57) ABSTRACT

A safety device (12) is disclosed for use in a hydraulic pump system (10). The device includes a generator (20) mounted between the power take off (14) and the hydraulic pump (24). Any time the hydraulic pump (24) is operated by the pto shaft (18) of the power take off (14), the generator is also powered to generate power to operate an audible alarm (28) such as a horn, siren or bell to warn the operator of pump operation. In a second embodiment, hydraulic pump system (100) uses a standard, readily available alternator (102) to generate power to operate the audible alarm (28). A selector valve (202) can be positioned between the pump (24) and lift cylinder to divert hydraulic fluid to a reservoir if the pump is inadvertently activated. The selector valve (202) can be operated manually by the driver when the vehicle is about to be put in motion by operating a control valve (212) or automatically by sensing vehicle motion, such as done by sensors in an ABS brake control.

19 Claims, 5 Drawing Sheets

SAFETY DEVICE FOR HYDRAULIC PUMP

TECHNICAL FIELD

This invention relates to control of hydraulics and particularly to a safety device for warning about activation of the hydraulics.

BACKGROUND OF THE INVENTION

Hydraulic pumps are used in many applications. Often, they are driven from a power take off shaft, or pto, as shown in FIG. 1, forming part of the drive train of a vehicle, such as a truck. One application is a semi-trailer dump truck where the bed of the trailer is tilted upward to dump the load by a hydraulic cylinder powered by a hydraulic pump mounted to a pto on the tractor portion of the vehicle. Another application is a dump truck with the bed integral with the truck.

In normal operation, the operator would engage the pto shaft with the transmission of the tractor to begin rotation of the pto shaft. The hydraulic pump is secured to the pto shaft such that rotation of the pto shaft operates the pump to generate pressurized hydraulic fluid. A hydraulic valve is mounted to the hydraulic pump and controls the flow of the pressurized hydraulic fluid. Normally the valve will have three positions, one position to supply the pressurized hydraulic fluid to the hydraulic cylinder to lift the bed of the trailer, a second position to allow hydraulic fluid to drain from the hydraulic cylinder to lower the bed and a third, neutral position where the pressurized hydraulic fluid simply circulates around in the hydraulic pump. The position of the hydraulic valve is usually controlled by the operator with a handle on the valve.

Significant forces are created in this operation. For example, a typical lift cylinder may exert 100,000 pounds of force to lift the bed of the trailer. Ideally, the hydraulic pump is never operated unless the bed is being lifted or lowered. However, unintended operation can occur, giving raise to the potential for damage. For example, a hydraulic pump driven too long in the neutral position can overheat and fail. A cab mounted light has been used within the tractor to warn the driver the pto is engaged. However, such lights can burn out and the wiring supplying the light can be broken. A need exists for a more reliable and more effective procedure to warn an operator or driver that the hydraulic pump has been activated.

SUMMARY OF THE INVENTION

In accordance with one aspect of the present invention, a safety device is provided for a hydraulic system that includes a rotating power drive and a hydraulic pump driven from the rotating power drive. The safety device includes a warning device and an electric generator driven by the rotating power drive to generate power to operate the warning device whenever the hydraulic pump is driven.

In accordance with another aspect of the present invention, the rotating power drive will drive the electric generator and the electric generator, in turn, will drive the hydraulic pump. The rotating power drive can be a pto shaft. The warning device can be an electrically operated horn, bell or siren or a light. The electric generator can include a common automotive or truck type alternator to generate the electrical power.

In accordance with yet another aspect of the present invention, the safety device includes a selector valve positioned between the pump and cylinder to divert pressurized hydraulic fluid from the pump back to a reservoir instead of to the cylinder upon activation by a safety control. The safety control can be an air valve operated manually when the cylinder is not to be lifted, or automatically by a signal provided from a source such as the ABS brake circuit found on many vehicles today which senses when a vehicle exceeds a predetermined speed, such as five miles per hour.

BRIEF DESCRIPTION OF THE DRAWINGS

For a more complete understanding of the present invention and the advantages thereof, reference is now made to the following Detailed Description, taken in conjunction with the accompanying Drawings, in which.

DETAILED DESCRIPTION

Figure 1:
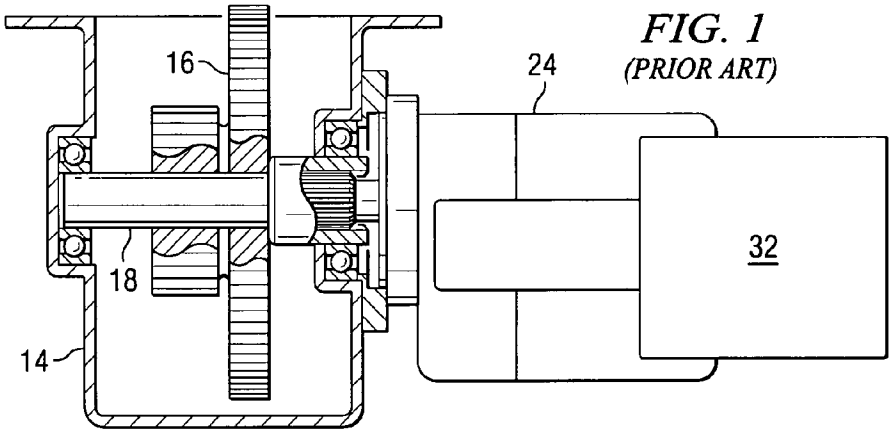
FIG. 1 (PRIOR ART)
FIG. 1 is a cross-sectional view of a prior art hydraulic system.
Figure 2:
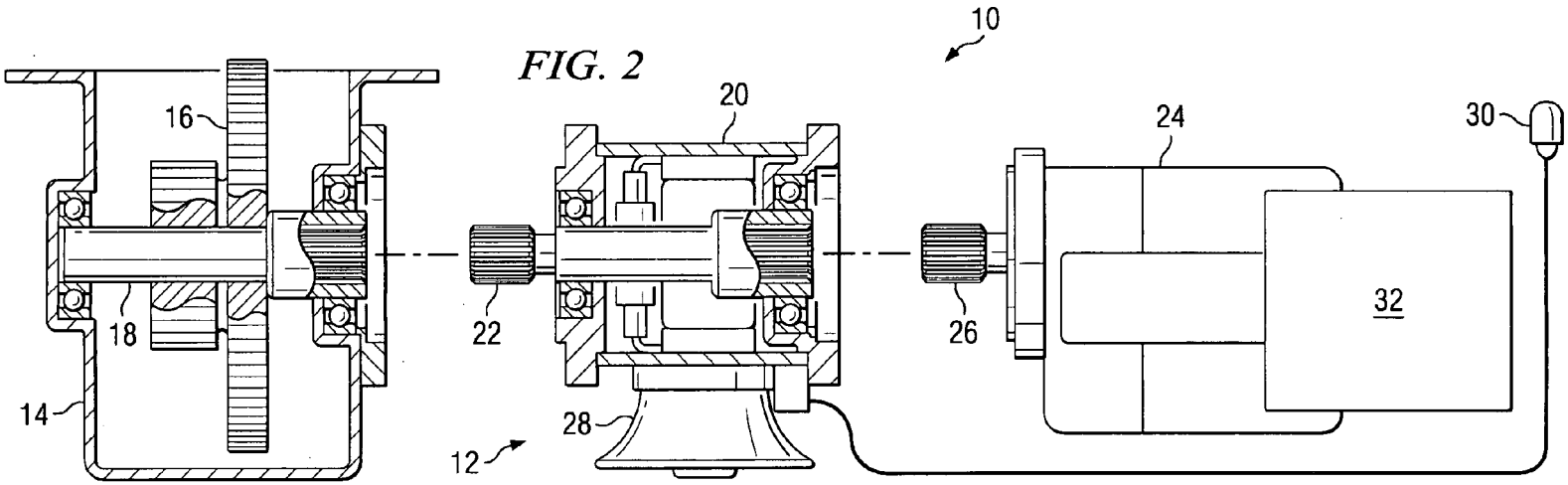
FIG. 2 is an exploded cross-sectional view of a first embodiment of the present invention illustrating the separated components.
Figure 3:
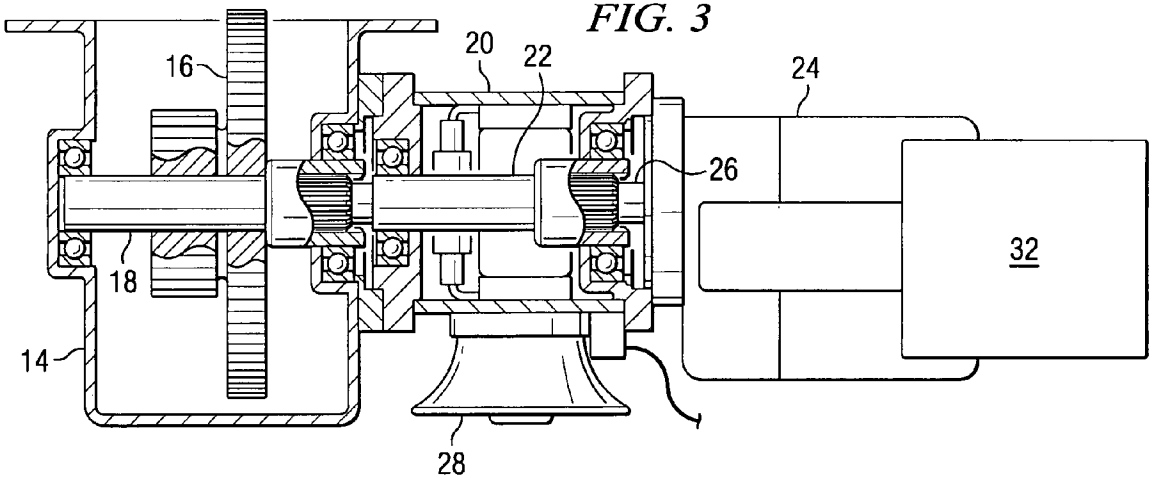
FIG. 3 is a cross-sectional view of the first embodiment assembled.
Figure 4:
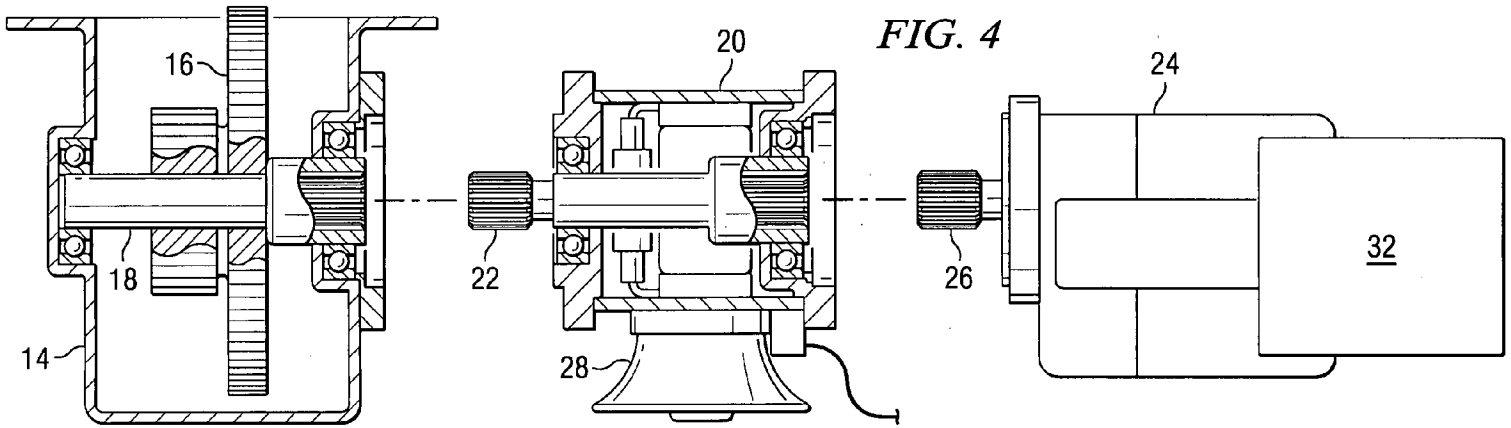
FIG. 4 is an enlarged view of FIG. 2 showing additional detail.

With reference now to FIGS. 2-4, a hydraulic pump system 10 with an integral safety device 12 forming a first embodiment of the present invention will be described. The hydraulic pump system 10 can be mounted to a tractor operating a dump semi-trailer. The dump trailer has a bed that can pivoted between a horizontal traveling position and a tilted dumping position to dump its load by a hydraulic cylinder powered by the hydraulic pump system 10. An example of such a dump trailer is illustrated in U.S. Pat. No. 4,531,753 issued Jul. 30, 1985 which patent is hereby incorporated herein by reference in its entirety.

The hydraulic pump system 10 includes a transmission mounted power take off 14 that is part of the transmission of the tractor to which it is mounted. A gear 16 within the power take off 14 can be engaged with the gearing of the transmission to rotate gear 16 with the prime mover of the tractor, usually its diesel engine. A power take off (pto) shaft 18 is connected for rotation with gear 16 so that when gear 16 is engaged, it will rotate the pto shaft 18 about its axis of rotation. A generator 20 is mounted to the power take off 14. The generator 20 includes a generator shaft 22 that is rotatably mounted within the generator 20 and is connected at one end thereof to the pto shaft 18 for rotation therewith. The generator 20 has the necessary electro-mechanical components such as armatures, stators etc. to generate 14 volts DC power when the pto shaft 18, and therefore the generator shaft 22, is rotated at sufficient speed. A hydraulic pump 24 is mounted directly to the generator 20. The hydraulic pump 24 has a pump shaft 26 that is connected to the end of generator shaft 22 opposite the pto shaft 18 so that rotation of the pto shaft 18 rotates the pump shaft 26 as well to create pressurized hydraulic fluid.

Mounted to the generator 20 is an audible warning device 28, such as a horn, that is powered directly by the 14 volt DC power generated by the generator 20. Preferably, the device 28 is powered directly from the generator 20 without any intervening switches or other connections so that whenever the pto shaft 18 rotates to operate the hydraulic pump 24, the generator 20 generates power to operate the device 28 to provide an audible warning of pump operation. If desired, power generated by the generator 20 can also be used to light a cab mounted audible and/or visual device 30 to warn the driver that the pump is in operation. The device 30 can also include a siren or horn as well as a warning light, for example.

An advantage of the present invention is that it provides a warning of pump operation that is very difficult if not impossible to deactivate. Since the generator 20 is bolted directly to the power take off 14, and the hydraulic pump 24 is, in turn, bolted directly to the generator 20, it would be very difficult to remove the generator 20. Further, since the pump shaft 26 can only be driven through the generator shaft 22, the hydraulic pump 24 can't generate pressurized hydraulic fluid without the generator 20 generating power to sound the audible alarm.

The pto shaft 18 typically rotates at speeds (for example 1800 rpm) sufficient to generate adequate power to operate the warning device 28 when operating the hydraulic pump 24. If the hydraulic control valve 32 mounted on the hydraulic pump 24 is in a position to allow the bed of the dump trailer to be moved by hydraulic fluid flowing to the lift cylinder, the generator 20 will provide power to the warning device 28 to alert the operator. In addition, even if the hydraulic control valve 32 is in the neutral position, causing the pressurized hydraulic fluid to simply circulate within the pump 24, the generator 20 will still provide power to the warning device 28 to generate an audible warning to the operator to prevent the hydraulic pump 24 from being ruined by heat buildup.

Figure 5:
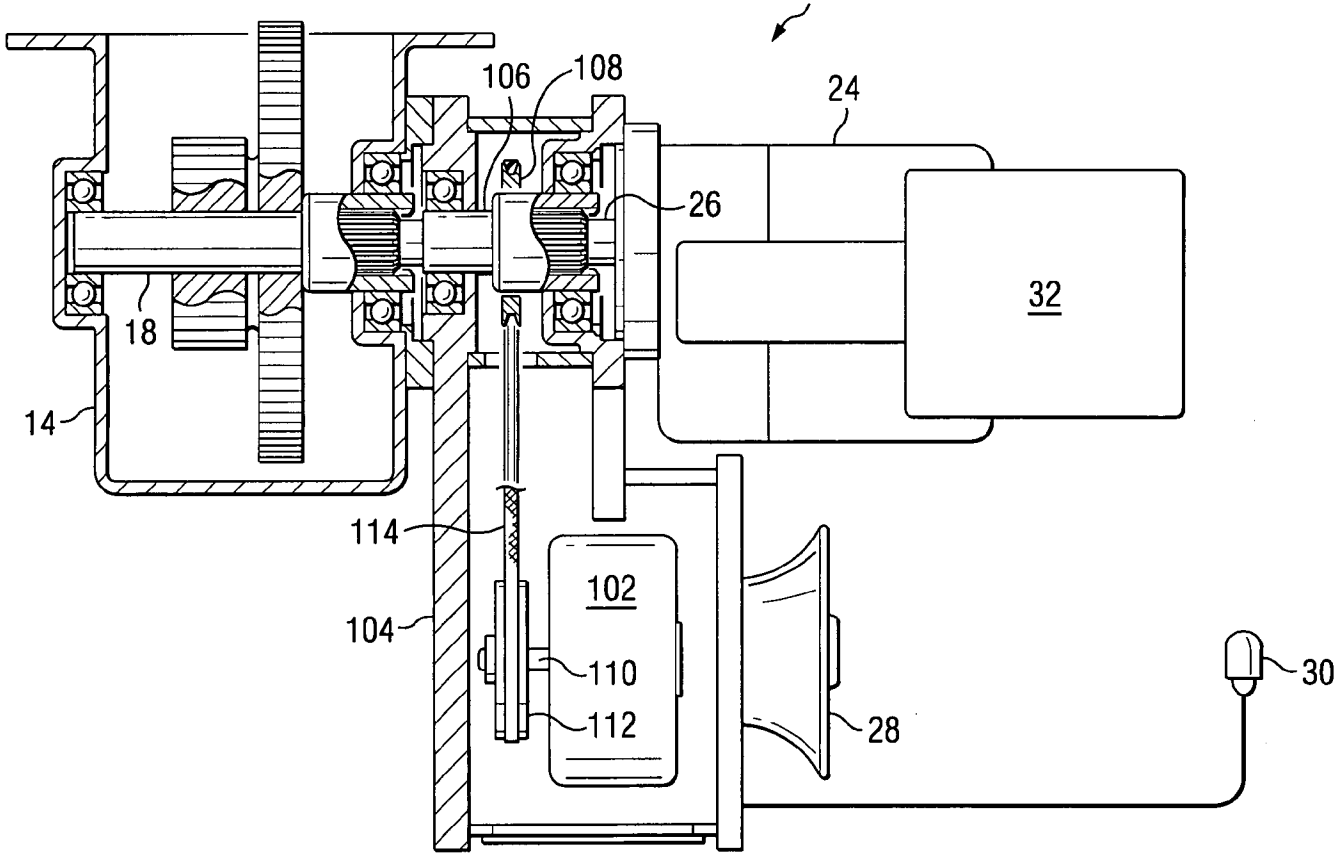
FIG. 5 is a cross-sectional view of a second embodiment of the present invention.
Figure 6:
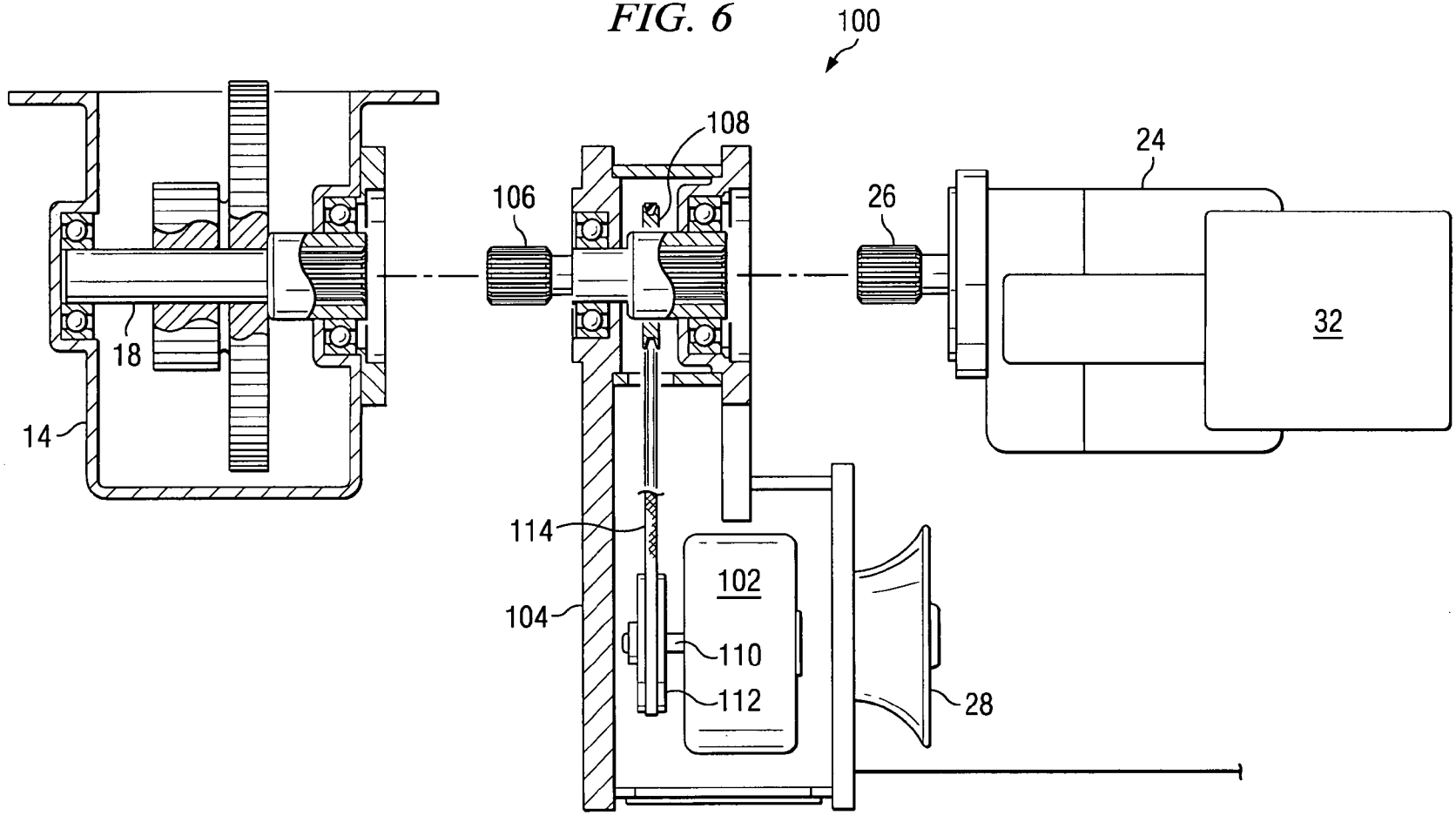
FIG. 6 is an exploded cross-sectional view of the second embodiment.

With reference to FIGS. 5 and 6, a hydraulic pump system 100 forming a second embodiment of the present invention will be described. Many components of system 100 are identical to system 10 and are identified by the same reference numerals. System 100, however, can utilize a standard 14 volt automotive or truck alternator 102 as the source of electrical power to power the audible warning device 28. The system 100 includes a body 104 bolted between the hydraulic pump 24 and power take off 14. An intermediate shaft 106 is rotatably supported within the body 104 by suitable bearings and is secured for rotation with the pto shaft 18 at one end thereof and secured for rotation with the pump shaft 26 at the other end to power the pump 24. A drive pulley 108 is mounted on the intermediate shaft 106 for rotation therewith.

The alternator 102 is mounted on the body 104 with the alternator shaft 110 rotating about an axis generally parallel the axis of rotation of the intermediate shaft 106, and spaced a predetermined distance therefrom. A driven pulley 112 is mounted to the alternator shaft 110. A V belt 114 around the pulleys 108 and 112 causes the driven pulley 112 and alternator shaft 110 to rotate when the intermediate shaft 106 rotates, generating power from the alternator 102. The field coil of the alternator 102 can be powered from the electrical system of the vehicle itself, or by a secondary generator operated by rotation of the intermediate shaft 106.

While the present invention has been described for use with a hydraulic system operating a dump trailer, it is clear the same system can be used for a dump truck and any other application requiring pressurized hydraulic fluid. It can be used with mobile applications, such as vehicles, or stationary applications. Further the present invention can be used whenever a rotating drive element, such as a pto shaft, is used to power, drive or operate any device simply by using some of the rotational energy of the rotating drive element to create power through the generator to power a warning device.

Figure 7:
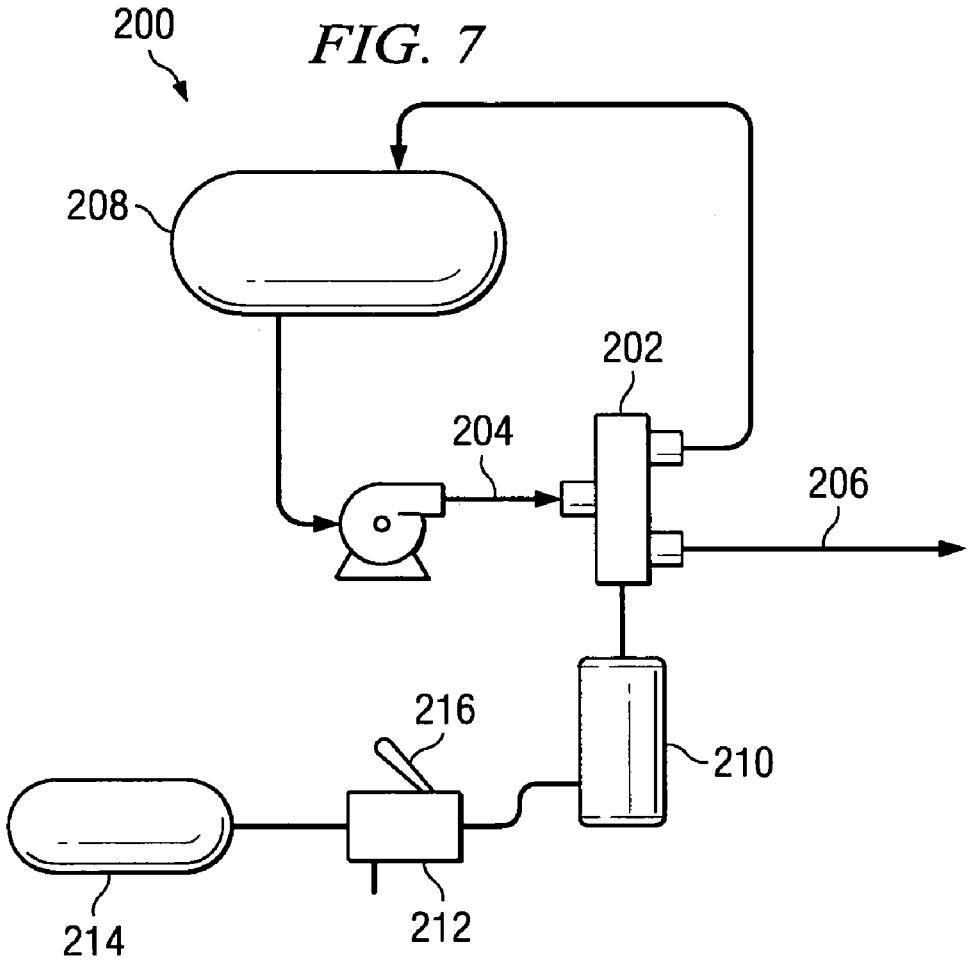
FIG. 7 is a schematic view of a hydraulic circuit illustrating a third embodiment of the present invention.

With reference now to FIG. 7, a hydraulic circuit 200 forming a third embodiment of the present invention will be described. In circuit 200, a spool selector valve 202 is mounted between the high pressure output line 204 from the pump and the line 206 to the lift cylinder on the trailer. The spool selector valve 202 is preferably mounted on the tractor. In one position of the valve 202, hydraulic fluid from the pump 24 can flow to the cylinder to lift the trailer bed. In the other position, the valve 202 will redirect any high pressure hydraulic flow to the reservoir 208 on the tractor, preventing lifting of the cylinder on the trailer.

The position of the valve 202 is controlled by an air cylinder 210 associated with the valve 202. Air cylinder 210, in turn, is controlled by a three-way air valve 212. The air valve 212 is connected to the air tank 214 which supplies air under pressure. The air valve 212 can be operated to supply air under pressure to the air cylinder 210 to move the valve 202 to the position preventing fluid flow to the cylinder. The air valve 212 can be manually operated as by the driver flipping the lever 216 when about to move the trailer to prevent inadvertent operation of the cylinder lifting the bed, or automatically by a suitable sensor sensing motion of the tractor and trailer. One suitable sensor would be the ABS brake control found on many vehicles, which includes a sensor that senses motion of the vehicle, usually when the vehicle speed exceeds five mile per hour. The sensor can be mounted on either the tractor or the trailer. When the ABS brake control senses this motion, it typically generates an electrical signal output at a port on the control that can be used to actuate the air valve 212 or preferably a remote control valve.

The hydraulic circuit 200 would prevent oil pressure from going to the trailer cylinder in the event the trailer was moving. To prevent the cylinder from lifting in the event that the PTO and control valve were both accidentally moved to engage and raise the cylinder, the driver would flip the air valve 212. This can be easily installed on older tractors that do not have an ABS braking system. For newer tractors that have ABS brake controls, a sensor output port on the ABS system could trigger the remote control valve to actuate air cylinder 210 and valve 202 in lieu of the three way air valve 212 at speeds in excess of five miles per hour.

The systems disclosed herein can all be installed on the tractor to prevent accidental flow of oil to the trailer which would raise the trailer or dump body bed, possibly resulting in an accident.

While several embodiments of the invention have been illustrated in the accompanying drawings and described in the foregoing Detailed Description, it will be understood that the invention is not limited to the embodiments disclosed, but is capable of numerous rearrangements, modifications and substitutions of parts and elements without departing from the spirit and scope of the invention.

The invention claimed is:

1. A safety device for a hydraulic system including a rotating power drive and a hydraulic pump driven from the rotating power drive, the safety device comprising:

a warning device;

an electric generator driven by the rotating power drive to generate power to operate the warning drive whenever the rotating power device operates the hydraulic pump independent of pressure generated by the pump.

2. The safety device of claim 1 wherein the rotating power drive directly drives the electric generator and the electric generator directly drives the hydraulic pump.

3. The safety device of claim 1 wherein the rotating power drive is a pto shaft.

4. The safety device of claim 3 wherein the generator has a generator shaft operably connected to the pto shaft for joint rotation.

5. The safety device of claim 4 wherein the hydraulic pump has a pump shaft operably connected to the generator shaft for joint rotation.

6. The safety device of claim 1 wherein the generator is mounted to the rotating power drive and the hydraulic pump is mounted to the generator.

7. The safety device of claim 1 wherein the warning device is an audible alarm such as a horn, buzzer or bell.

8. The safety device of claim 1 wherein the safety device is mounted on a vehicle having a cab, the warning device including a cab mounted audible and/or visual warning device.

9. The safety device of claim 1 wherein the generator includes a body mounting an intermediate shaft, a V belt and an alternator having an alternator shaft, the intermediate shaft being rotated by the rotating power drive, the alternator shaft being rotated by the intermediate shaft through the V belt, thereby driving the alternator to generate the power to operate the warning device.

10. A hydraulic system, comprising:

a rotating power drive;

a warning device;

an electric generator driven by the rotating power drive to generate power to operate the warning device;

a hydraulic pump driven by the rotating power drive through the generator to create pressurized hydraulic fluid, the warning device operating whenever the rotating power drive operates the hydraulic pump, the operation of the warning device being independent of pressure generated by the hydraulic pump.

11. The hydraulic system of claim 10 wherein the rotating power drive directly drives the electric generator and the electric generator directly drives the hydraulic pump.

12. The hydraulic system of claim 10 wherein the rotating power drive is a pto shaft.

13. The hydraulic system of claim 12 wherein the generator has a generator shaft operably connected to the pto shaft for joint rotation.

14. The hydraulic system of claim 13 wherein the hydraulic pump has a pump shaft operably connected to the generator shaft for joint rotation.

15. The hydraulic system of claim 10 wherein the generator is mounted to the rotating power drive and the hydraulic pump is mounted to the generator.

16. The hydraulic system of claim 10 wherein the warning device is an audible alarm such as a horn, buzzer or bell.

17. The hydraulic system of claim 10 wherein the hydraulic system is mounted on a vehicle having a cab, the warning device including a cab mounted audible and/or visual warning device.

18. The hydraulic system of claim 10 wherein the generator includes a body mounting an intermediate shaft, a V belt and an alternator having an alternator shaft, the intermediate shaft being rotated by the rotating power drive, the alternator shaft being rotated by the intermediate shaft through the V belt, thereby driving the alternator to generate the power to operate the warning device.

19. A method of generating an alarm when a hydraulic pump is operated by a rotating power drive, comprising the steps of:

driving a generator with the rotating power drive whenever the rotating power drive operates the hydraulic pump, and generating an audible alarm with power generated by the generator whenever the rotating power drive operates the hydraulic pump independent of pressure generated by the pump.

* * * * *